US006590983B1

(12) United States Patent
Kraemer

(10) Patent No.: US 6,590,983 B1
(45) Date of Patent: Jul. 8, 2003

(54) APPARATUS AND METHOD FOR SYNTHESIZING PSEUDO-STEREOPHONIC OUTPUTS FROM A MONOPHONIC INPUT

(75) Inventor: Alan D. Kraemer, Tustin, CA (US)

(73) Assignee: SRS Labs, Inc., Santa Ana, CA (US)

( * ) Notice: Subject to any disclaimer, the term of this patent is extended or adjusted under 35 U.S.C. 154(b) by 0 days.

(21) Appl. No.: 09/170,363

(22) Filed: Oct. 13, 1998

(51) Int. Cl.[7] ..... H04R 5/00
(52) U.S. Cl. ..... 381/17; 381/18; 381/97
(58) Field of Search ..... 381/17, 18, 19, 381/20, 21, 22, 23, 98, 1, 11, 101, 103, 97

(56) References Cited

U.S. PATENT DOCUMENTS

| | | | |
|---|---|---|---|
| 3,541,266 | A | 11/1970 | Klayman et al. |
| 4,239,939 | A | 12/1980 | Griffis |
| 4,308,424 | A | 12/1981 | Bice, Jr. |
| 4,394,535 | A | 7/1983 | Bingham et al. |
| 4,479,235 | A | 10/1984 | Griffis |
| 4,489,432 | A | 12/1984 | Polk |
| 4,496,979 | A | 1/1985 | Yu et al. |
| 4,594,610 | A | 6/1986 | Patel |
| 4,594,730 | A | 6/1986 | Rosen |
| 4,625,326 | A | 11/1986 | Kitzen et al. |
| 4,633,495 | A | 12/1986 | Schotz |
| 4,685,134 | A | 8/1987 | Wine |
| 4,706,287 | A | 11/1987 | Blackmer et al. |
| 4,748,669 | A | 5/1988 | Klayman |
| 4,819,269 | A | 4/1989 | Klayman |
| 4,836,329 | A | 6/1989 | Klayman |

(List continued on next page.)

FOREIGN PATENT DOCUMENTS

| | | | |
|---|---|---|---|
| DE | 3 331 352 A1 | | 8/1983 |
| EP | 0 015 770 A1 | | 9/1980 |
| EP | 0 097 982 A3 | | 1/1984 |
| GB | 2 157 475 A | | 4/1984 |
| JP | 55161500 | * | 12/1980 |
| JP | 408256400 A | * | 10/1996 |
| NL | 8 204 980 | | 12/1982 |
| WO | WO 87/06090 | | 10/1987 |

OTHER PUBLICATIONS

Schroeder, M.R., "An Artificial Stereophonic Effect Obtained from a Single Audio Signal", Journal of the Audio Engineering Society, vol. 6, No. 2, pp. 74–79, Apr. 1958.
Kurozumi, K., et al., "A New Sound Image Broadening Control System Using a Correlation Coefficient Variation Method", Electronics and Communications in Japan, vol. 67–A, No. 3, pp. 204–211, Mar. 1984.
Dickey, R., "Outputs of Op–Amp Networks Have Fixed Phase Difference", (no publication title listed), pp. 129–130 (no date listed).

*Primary Examiner*—Duc Nguyen
(74) *Attorney, Agent, or Firm*—Knobbe Martens Olson & Bear, LLP.

(57) ABSTRACT

A sound enhancement system (synthesizer) disclosed. The enhancement system synthesizes pseudo-stereophonic left and right output channels output from a monophonic input channel. The monophonic input signal is applied to a perspective filter that produces a differential-mode signal and to an equalizer filter that produces a common-mode signal. The perspective filter attenuates signal components in a frequency range corresponding to the human voice. The equalizer filter attenuates signal components in a frequency range outside the frequency range of the human voice. The equalizer filter also provides a 90 degree phase shift. The differential-mode and the common-mode signals are combined to produce the output channels. The pseudo-stereo output provided by the synthesizer has relatively less ambience in the frequency range corresponding to the human voice and relatively more ambience in frequency ranges that do not correspond to the human voice.

78 Claims, 9 Drawing Sheets

U.S. PATENT DOCUMENTS

| | | | | |
|---|---|---|---|---|
| 4,841,572 | A | | 6/1989 | Klayman |
| 4,866,774 | A | | 9/1989 | Klayman |
| 4,972,489 | A | * | 11/1990 | Oki et al. |
| 5,177,329 | A | | 1/1993 | Klayman |
| 5,251,260 | A | | 10/1993 | Gates |
| 5,319,713 | A | | 6/1994 | Waller, Jr. et al. |
| 5,333,201 | A | | 7/1994 | Waller, Jr. |
| 5,339,363 | A | * | 8/1994 | Fosgate |
| 5,459,813 | A | | 10/1995 | Klayman |
| 5,638,452 | A | | 6/1997 | Waller, Jr. |
| 5,661,808 | A | | 8/1997 | Klayman |
| 5,771,295 | A | | 6/1998 | Waller, Jr. |
| 5,784,468 | A | | 7/1998 | Klayman |
| 5,850,453 | A | | 12/1998 | Klayman et al. |
| 5,870,480 | A | * | 2/1999 | Griesinger |
| 5,995,631 | A | * | 11/1999 | Kamada et al. |
| 6,122,381 | A | * | 9/2000 | Winterer |
| 6,243,476 | B1 | * | 6/2001 | Gardner |

* cited by examiner

APPARATUS AND METHOD FOR SYNTHESIZING PSEUDO-STEREOPHONIC OUTPUTS FROM A MONOPHONIC INPUT

BACKGROUND OF THE INVENTION

1. Field of the Invention

The disclosed invention relates to systems for stereo sound reproduction, and is particularly directed to systems that synthesize pseudo-stereophonic output signals from a monophonic input signal.

2. Description of the Related Art

Monophonic reproduction of sound is the reproduction of sound through a single channel. When a sound source such as an orchestra is recorded and reproduced monophonically (i.e., reproduced by a single loudspeaker), much of the color and depth of the recording is lost in the reproduction. Even if the monophonic recording is reproduced through two spatially separated loudspeakers, the orchestral sounds will still appear to emanate from essentially a point somewhere between the loudspeakers.

Stereophonic reproduction occurs when the orchestra is recorded on two different sound channels by two separate microphones. Upon reproduction by a pair of loudspeakers, the orchestra does not appear to emanate from a single point between the loudspeakers, but instead appears to be distributed throughout and behind the plane of the two loudspeakers. The two-channel recording provides for the reproduction of a sound field which enables a listener to both locate various sound sources (e.g., individual instruments or voices) and to sense the acoustical character of the recording room or concert hall.

True stereophonic reproduction is characterized by two distinct qualities that distinguish it from single-channel reproduction. The first quality is the directional separation of sound sources to produce the sensation of width. The second quality is the sensation of depth and presence that it creates. The sensation of directional separation has been described as that which gives the listener the ability to judge the selective location of various sound sources, such as the position of the instruments in an orchestra. The sensation of presence, on the other hand, is the feeling that the sounds seem to emerge, not from the reproducing loudspeakers themselves, but from positions in between and usually somewhat behind the loudspeakers. The latter sensation gives the listener an impression of the size, acoustical character, and the depth of the recording location. The term "ambience" has been used to describe the sensation of width, depth, and presence. In other words, the term ambience is often used to describe width, depth and presence when directional separation is excluded.

Two-channel stereophonic sound reproduction preserves both qualities of directional separation and ambience. Synthesized stereophonic sound reproduction, also known as pseudo-stereophonic reproduction, typically does not attempt to recreate stereo directionality, but only the sensation of ambience that is a characteristic of true two-channel stereo.

When a two-channel stereophonic sound reproduction system is used in combination with a visual medium, such as television or motion pictures, the two qualities of directional separation and ambience create in the listener a sense of immersion in the audio-visual scene. The sensation of ambience will recreate the acoustical properties of the recording studio or location, and the directional sensation will make various sounds appear to emanate from their respective locations in the visual image. In addition, since the ambience produces the feeling that sounds are coming from positions behind the plane of the loudspeakers, a certain three-dimensional effect is also produced.

It is also possible for the synthesized stereo system to create a disturbing separation sensation in the mind of the listener if the frequency spectrum is improperly divided between the two loudspeakers. The synthesized stereo system achieves its intended effect by controlling the relative amplitudes and/or phases of the sound signals as a function of the audible frequency spectrum at: the reproducing loudspeakers. Listeners are naturally very familiar with the sound of a human voice and can easily distinguish a human voice from among a number of instruments or other background noise. Thus, it can be very disconcerting to a listener if a voice appears to wander back and forth across a soundstage. By contrast, listeners are generally less able to pick out a particular instrument from a group of instruments. Thus, it is generally less disturbing to a listener if the sound from one particular instrument appears to wander across the soundstage. Many prior art stereo synthesizers use time delays or other broadband signal processing elements to manipulate a monophonic signal to produce a pseudo-stereophonic signal in a way that adds an unnatural ambience to human voices and causes the voice to appear to wander unnaturally about the soundstage.

SUMMARY OF THE INVENTION

Embodiments of the invention solve these and other problems by using sound enhancement signal processing designed to manipulate a monophonic signal to produce a pseudo-stereophonic signal in a manner that is pleasing to the ear. The signal processing adds relatively more ambience to the musical instruments in the monophonic signal and relatively less ambience to the human voices in the monophonic signal.

More generally, the sound enhancement signal processing can be used to produce multiple output channels from a single input channel, such that the output channels have more ambience than the input channel. For example, the input channel may be a monophonic input channel, and the outputs may be amplified and used to drive left and right stereophonic loudspeakers.

One embodiment is a synthesizer which provides more output channels than input channels. In one embodiment, the synthesizer develops two or more filtered output signals from a single input signal. The input signal is applied to a perspective filter that produces a differential-mode output signal. The input signal is also applied to an equalizer filter that produces a common-mode output signal. The differential-mode and the common-mode signals are combined to produce output channels.

The two-channel synthesizer is desirably used as a stereophonic synthesizer that generates left and right pseudo-stereophonic output channels from a single monophonic input channel. The left output channel is produced by a left channel combiner, and the right output channel is produced by a right channel combiner.

The synthesizer may be constructed using analog components such as operational amplifiers (op-amps). Alternatively, the synthesizer may be implemented in software on a computer, such as, for example, a microprocessor or a Digital Signal Processor (DSP).

The synthesizer phase-equalizes the outputs such that the output channels are substantially in phase in a frequency band corresponding to human voice, including the formant frequencies of the human voice, so as to avoid unwanted ambience in the human voice while enhancing the ambience effect of other, more randomly distributed sound signals. When the synthesizer is used as a stereophonic synthesizer to generate left and right pseudo-stereophonic inputs from a monophonic input, the phase-equalization centers the human voices on a sound stage and also provides increased quality in the reproduction of speech sounds.

In accordance with one embodiment of the invention, a wider stereo sound image and listening area are achieved by generating common-mode and differential-mode signals from a monophonic input signal by selectively altering the relative amplitudes and phases of the monophonic signal frequencies and the relative amplitudes of the sum signal frequencies, and combining the common-mode and differential-mode signals to produce pseudo-stereophonic left and right channel signals.

To produce the common-mode signal, selected frequency components of the monophonic signal are boosted relative to other signal frequency components of the monophonic input signal. Moreover, selected phase components of the monophonic signal are shifted relative to other phase components of the monophonic input signal to further shape the common-mode signal. The selective boosting and phase shifting to produce the common-mode signal prevents the common-mode signal from being overwhelmed by the differential-mode signal.

To produce the differential-mode signal, selected frequency components of the monophonic signal are attenuated (de-emphasized) relative to other monophonic signal frequency components. The selective boosting to produce the differential-mode signal provides for a wider stereo image and a wider listening area. The selective emphasis or boost of the differential-mode signal components provides a wider stereo image, and the harshness and image shifting problems associated with indiscriminate increase of the differential-mode signal are substantially reduced by the equalization provided by the equalizer.

The selective emphasis or boost of selected components in the differential-mode signal further enhances the stereo image because it provides the perception of ambient sounds that are heard at a live performance but often masked in recordings. For example, a listener at a live indoor musical performance hears both the sounds that radiate directly from the instruments, sounds reflected from walls and other objects, and reverberant sounds created by the enclosed nature of an auditorium. At a live performance the ambient (e.g., reflected and reverberant sounds) are readily perceived and are not masked by the direct sounds. In a recorded performance, however, the ambient sounds are masked by the direct sounds, and are not perceived at the same level as at a live performance. The ambient sounds generally tend to be in the quieter frequencies of the difference signal, and boosting the quieter frequencies of the difference signal unmasks the ambient sounds, thereby simulating the perception of ambient sounds at a live performance.

The selective emphasis of the differential-mode signal also provides for a wider listening area for the following reasons. The louder frequency components of the differential-mode signal tend to be outside the mid-range, which includes frequencies corresponding to human voices and frequencies having wavelengths comparable to the ear-to-ear distance around the head of a listener. As a result of the selective emphasis provided by one embodiment of the invention, components at frequencies where a listener has increased phase sensitivity are not inappropriately boosted. Therefore, the stereophonic image-shifting problem resulting from indiscriminate increase of the difference signal (discussed above) is substantially reduced, and the listener is able to localize human voices on the soundstage.

In providing the selective boosting of the differential-mode signal, the amount of enhancement, which is determined by the level of the selectively boosted difference signal that is mixed, is set so that the amount of ambience provided is relatively consistent and pleasing to the ear.

Embodiments of the invention are also directed to playback of monophonic phonograph records, magnetic tapes, radio and television broadcasts, movie soundtracks, and digital discs through a conventional sound reproducing system. Embodiments of the invention are also applicable for making pseudo-stereophonic recordings on any medium, including, for example, phonograph records, digital discs or magnetic tape which recordings can be played on a conventional sound reproducing system to produce left and right stereo output signals providing the advantageous effects described above.

BRIEF DESCRIPTION OF THE DRAWINGS

The advantages and features of the disclosed invention will readily be appreciated by persons skilled in the art from the following detailed description when read in conjunction with the drawings listed below.

Figure 1:
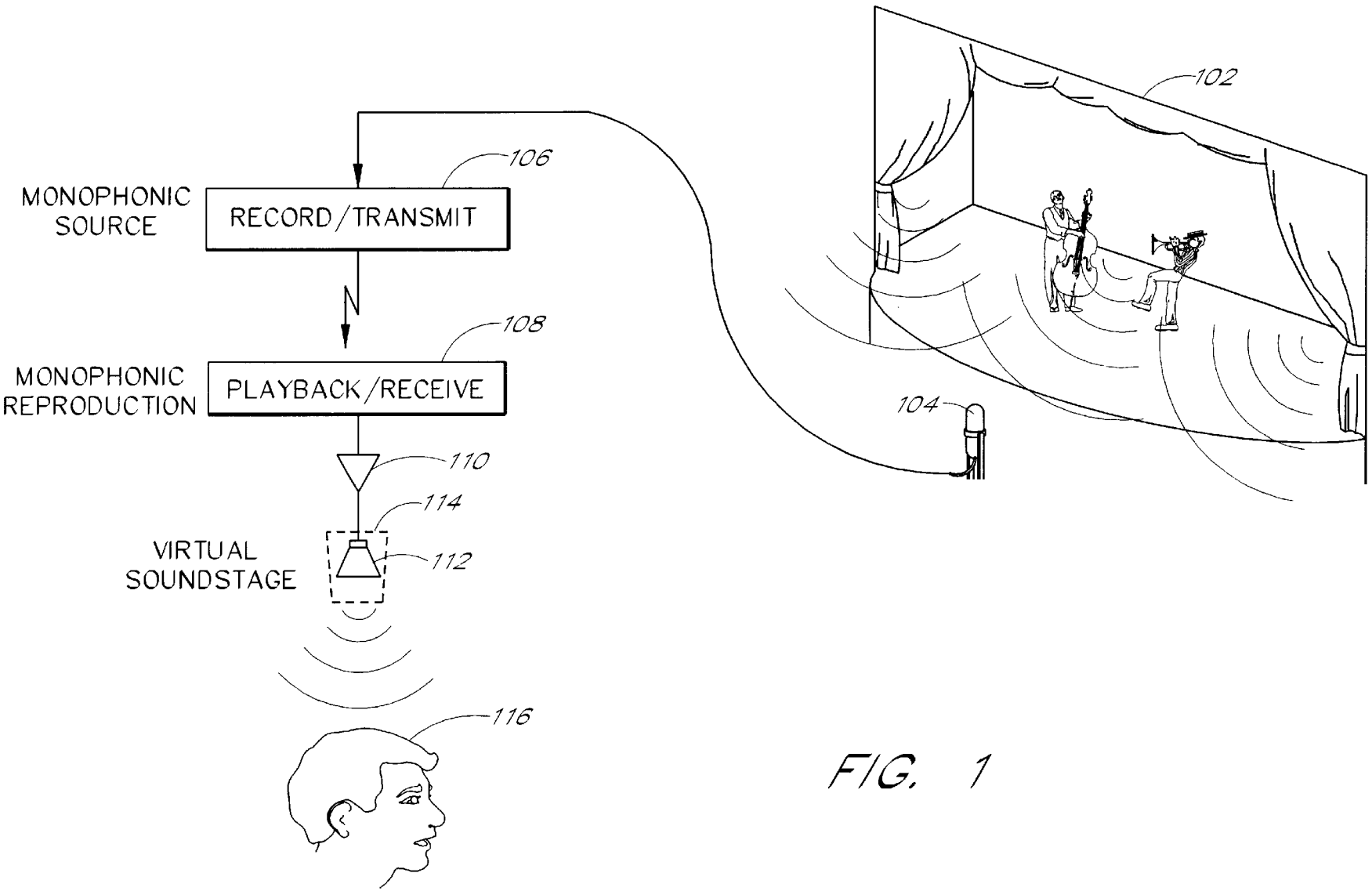
FIG. 1 is a block diagram of a monophonic recording and playback system.

In the drawings, the first digit of any three-digit number typically indicates the number of the figure in which the element first appears. Where four-digit reference numbers are used, the first two digits indicate the figure number.

DETAILED DESCRIPTION

In order to facilitate the understanding of the invention, an overview is first presented wherein the overall functions provided are discussed. Then, the invention is discussed in more detail with more emphasis on operating parameters.

I. Overview

As summarized above, one embodiment of the invention comprises a synthesizer which generates two or more output channels from an input channel, such that the output channels have more ambience than the input channel. For convenience and clarity of presentation, the discussion which follows assumes that the input channel is a monophonic input and the synthesizer provides a left pseudo-stereo output channel and a right pseudo-stereophonic output channel. One skilled in the art will readily appreciate that the input need not be a monophonic input, and that embodiments of the present invention can be used in many applications where the ambience of reproduced sound is produced by generating a plurality of output channels from a single input channel.

FIG. 1 is a block diagram of a monophonic recording and playback system wherein a single microphone 104 is used to convert sounds into information in a single (monophonic) information stream 107. As used herein, the term information may include any form of data representation, including for example, electrical signals, electromagnetic signals, magnetic domains, optical pits, internet packets, digital values, analog or digital recordings, data in a computer program or disk file, etc. The sounds converted by the microphone 104 come from sources scattered across a soundstage 102 having width and depth. Sounds converted by the microphone 104 may also come from reflections off of walls or other objects (not shown) near the soundstage 102 and from reverberances in a room (not shown) surrounding the soundstage 102.

The information in the information stream 107 is provided to a record/transmit (sending) block 106. The sending block 106 provides the information stream 107 to a playback/receive (receiving) block 108. The sending block 106 represents any device or technology that is adapted to store or transmit information, including, for example, a radio/TV transmitter, a CD recording, a magnetic recording, a disk file, the internet, etc. Likewise, the receiving block 108 represents any device or technology that is adapted to receive information from the sending block 106 and converts the information stream 107 into electrical signals that are provided to an input of an; amplifier 110. An output of the amplifier 110 is provided to a loudspeaker 114. When a listener 116 hears the sounds reproduced by the loudspeaker 114, the listener 116 perceives a virtual soundstage 114.

Since the sound from the soundstage 102 is converted by a single microphone 104 and reproduced by a single loudspeaker 112, the virtual soundstage 114 is much smaller than the real soundstage 102. The listener 116 will perceive a localized sound image, corresponding to the small virtual sound stage 114, having little width or ambience. By contrast, a listener placed near the microphone 104, and hearing the sounds produced by a live performance on the real soundstage 102, would perceive a much larger sound image corresponding to the real soundstage 102.

Figure 2:
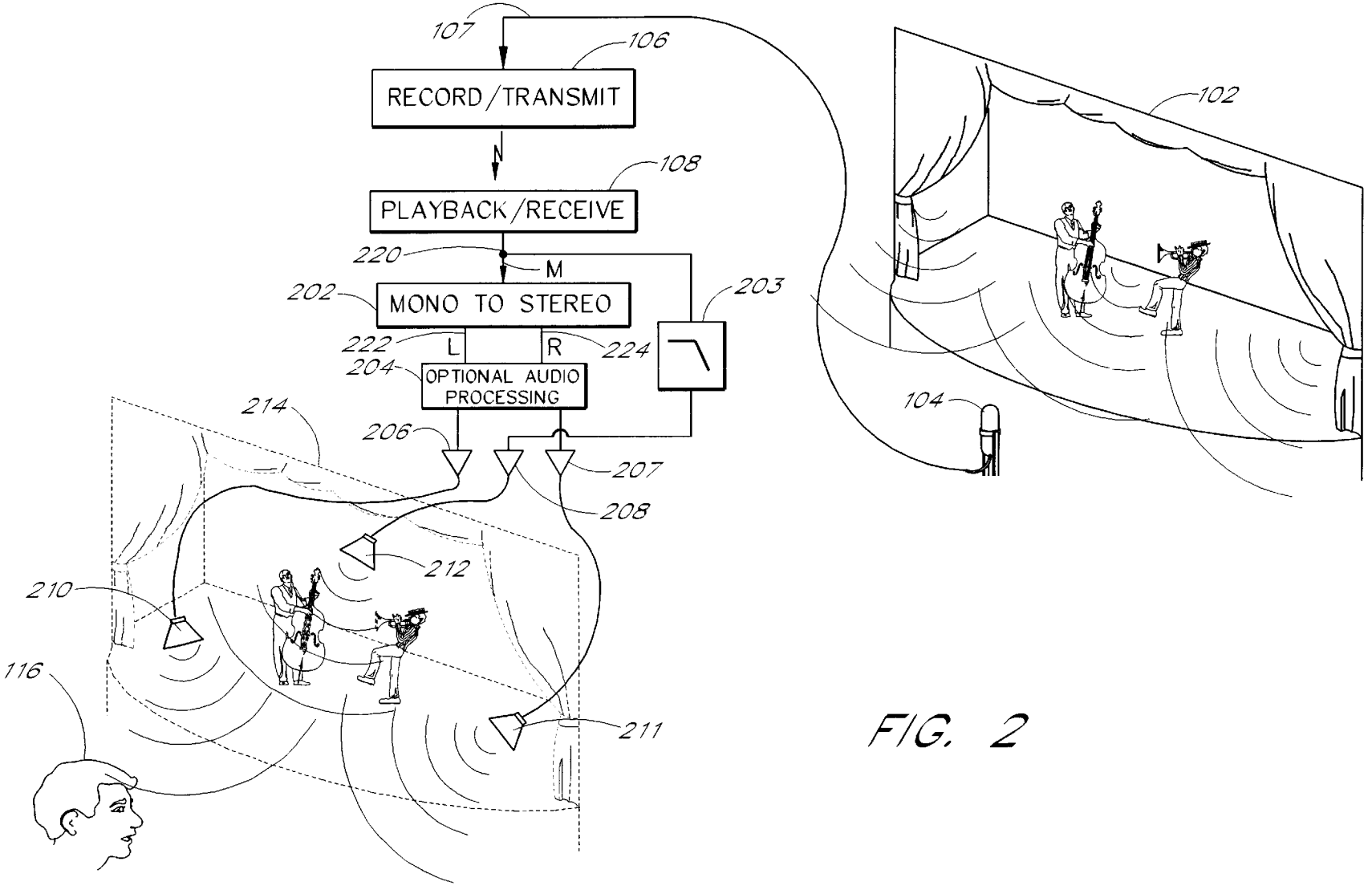
FIG. 2 is a block diagram of a monophonic recording system with a pseudo-stereophonic playback system.

FIG. 2 is a block diagram of a monophonic recording system similar to that shown in FIG. 1, but with a pseudo-stereophonic playback system. In FIG. 2 the single microphone 104 is used to convert sounds into information in the single (monophonic) information stream 107. As in FIG. 1, the sounds converted by the microphone 104 come from sources scattered across a soundstage 102 having width and depth, from reflections off of walls or other objects, and from reverberances in the room. The information in the information stream 107 is provided to a record/transmit (sending) block 106. The sending block 106 provides the information stream 107 to a playback/receive (receiving) block 108.

The receiving device 108 provides monophonic information 220 to a first input of an enhancement system 202 and to an input of a lowpass filter 203. The enhancement system 202 provides a left-channel pseudo-stereophonic output and a right-channel pseudo-stereophonic output to an audio-processing block 204. The audio-processing block 204 may provide further audio enhancement such as tone controls, balance controls, etc. The audio-processing block 204 provides a left-channel output to a left amplifier 206 and a right channel output to a right amplifier 207. The audio processing block 204 is optional and may be eliminated, in which case the left and right channel outputs from the enhancement system 202 are provided directly to the left and right amplifiers 206 and 207, respectively. An output of the left amplifier 206 is provided to a left speaker and an output of the right amplifier 207 is provided to a right speaker.

An output of the lowpass filter 203 is provided to an input of a bass amplifier 208 and an output of the bass amplifier 208 is provided to a loudspeaker 212. The lowpass filter 203, the bass amplifier 208, and the loudspeaker 212 are optional and may be eliminated. The listener 116 hears the sounds reproduced by the loudspeakers 210–212, and perceives a virtual soundstage 214.

The enhancement system 202 may be implement using analog signal processing, digital signal processing, or combinations thereof. The enhancement system 202 may also be implemented in software on a computer processor such as, for example, an Intel Corp. Pentium processor or its progeny. The enhancement system 202 may also be implemented as a software program in a Digital Signal Processor (DSP).

The stereo enhancement system 202 may be readily incorporated for production into audio preamplifiers that are manufactured and sold as separate units, as well as into audio preamplifiers that are included in integrated amplifiers and receivers.

For use with standard commercially available audio components, an embodiment of the stereo enhancement system 202 may be utilized in the tape monitor loop or, if available, in an external processor loop of a preamplifier. Such loops are not affected by the preamplifier controls such as tone controls, balance control, and volume control. Alternatively, the stereo enhancement system 202 may be interposed between the preamplifier and power amplifier of a standard stereophonic sound reproduction system.

As is well known, a stereophonic sound reproduction system attempts to produce a sound image wherein the reproduced sounds are perceived as emanating from different locations across the soundstage 214, thereby simulating the experience of a live soundstage 102. The aural illusion of a stereo sound image is generally perceived as being between left and right loudspeakers 210 and 211, and the width of the stereo image depends to a large extent on the similarity or dissimilarity between the information respectively provided to the left and right loudspeakers 210 and 211. If the information provided to each loudspeaker is the same (e.g., monophonic) then the sound image is predominantly centered between the loudspeakers at "center stage." In contrast, if the information provided to each loudspeaker is different, then the extent of the sound image spreads between the two loudspeakers.

The width of the stereo sound image depends not only on the information provided to the loudspeakers, but also on listener position. Ideally, the listener is equidistant from the loudspeakers. With many loudspeaker systems, as the listener gets closer to one loudspeaker, the sound from the more distant loudspeaker contributes less to the stereo image, and the sound is quickly perceived as, emanating only from the closer loudspeaker. This is particularly so when the information in each loudspeaker is similar. Therefore, the enhancement system provides left and right channel outputs which are dissimilar.

The enhancement system 202 converts the monophonic input signal 220 into left and right output pseudo-stereophonic output signals having more ambience than would be obtained by simply providing the monophonic signal 220 directly to the amplifiers 206 and 207. There have been numerous prior-art attempts to add ambience to a monophonic signal, with mixed results. By contrast, the sound enhancement system 202 advantageously generates a differential-mode signal that is analogous to a difference signal (L−R). Portions of the differential-mode signal are emphasized (boosted) relative to other portions of the differential-mode signal which are de-emphasized (attenuated).

Figure 3:
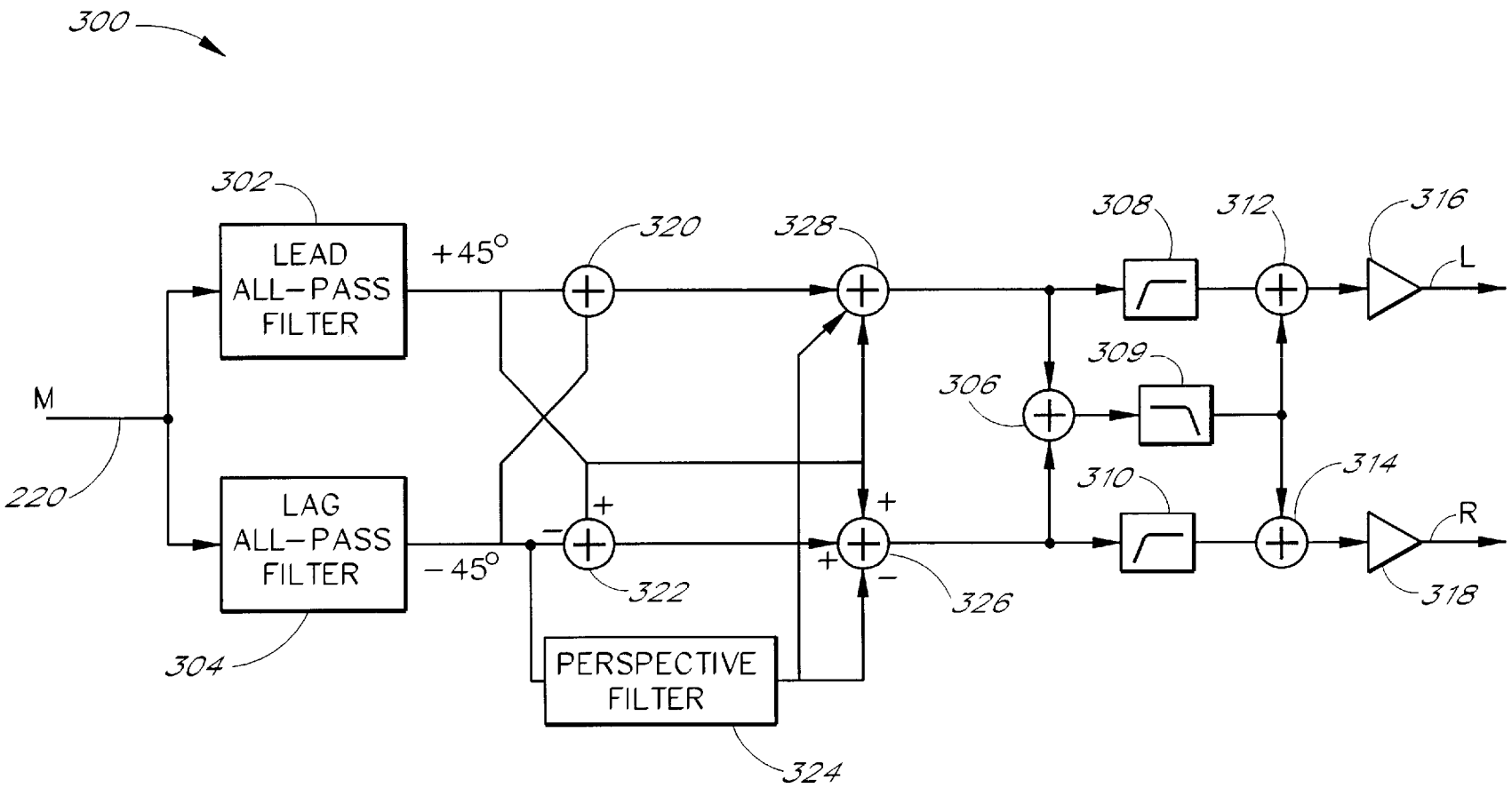
FIG. 3 is a block diagram of one embodiment of a sound enhancement system that uses all-pass filters to generate two pseudo-stereophonic output channels from a single monophonic input channel.

FIG. 3 shows one embodiment of an enhancement system 202 that uses a left all-pass filter 302 and a right all-pass filter 304 to add ambience to a monophonic input signal M 220. The signal M is provided to the left all-pass filter 302 and to the right all-pass filter 304. The left all-pass filter 302 is a phase-lead filter that produces a leading phase shift of +45 degrees. The right all-pass filter 304 is a phase-lag filter that produces a lagging phase shift of −45 degrees.

An output of the filter 302 is provided to a first input of an adder 320 and to a non-inverting (summing) input of a combiner 322. An output of the filter 304 is provided to a second input of the adder 320 and to an inverting (subtracting) input of a combiner 322. An output of the adder 320 is provided to a first input of an adder 328. An output of the combiner 322 is provided to a non-inverting input of a combiner 326.

The output of the filter 304 is also provided to an input of a perspective filter 324. An output of the perspective filter 324 is provided to an inverting input of the combiner 326 and to a second input of the adder 328. The output of the filter 302 is also provided to a third input of the adder 328 and to a non-inverting input of the combiner 326.

An output of the adder 328 is provided to a highpass filter 308 and to a first input of an adder 306. An output of the combiner 326 is provided to a highpass filter 310 and to a second input of the adder 306. An output of the adder 306 is provided to a lowpass filter 309.

An output of the highpass filter 308 is provided to a first input of an adder 312 and an output of the lowpass filter 309 is provided to a second input of the adder 312. An output of the adder 312 is provided to an input of a left channel output amplifier 316 and an output of the amplifier 316 is provided to a left channel output.

An output of the highpass filter 310 is provided to a first input of an adder 314 and an output of the lowpass filter 309 is provided to a second input of the adder 314. An output of the adder 314 is provided to an input of a right channel output amplifier 318 and an output of the amplifier 316 is provided to a right channel output.

The enhancement system 300 produces left and right pseudo-stereophonic outputs by using the all-pass filters 302, 304 to introduce phase shifts across the entire audio spectrum. Low frequency portions of a left plus right (L+R) signal provided by the adder 306 are mixed with the left and right channels by the adders 312 and 314, respectively. At frequencies above the rolloff frequency of the lowpass filter 309, very little of the L+R signal is added to the left and right channel. Thus, at frequencies above the rolloff frequency of the lowpass filter 309, the left and right channels are essentially in quadrature (i.e., approximately 90 degrees apart). At low frequencies below the rolloff frequency of the lowpass filter 309, some of the L+R signal is added to the left and right channels. Thus, at lower frequencies not too far removed from the cutoff frequency of the lowpass filter 309, the left and right channels are less than 90 degrees apart. At very low frequencies, the highpass filters 308 and 310 attenuate most of the left and right channel signals such that the left and right output signals predominantly derive from the (L+R) signals provided at the output of the lowpass filter 309. Thus, at very low frequencies, the left and right output signals are substantially in phase.

The enhancement system 300, shown in FIG. 3, provides pseudo-stereophonic enhancement of a monophonic input signal, but may produce too much ambience in the frequency ranges corresponding to the human voice, and too little ambience in frequency ranges above and below the human voice frequency band.

Indiscriminately increasing the difference signal can create problems since the stronger frequency components of the difference signal tend to be concentrated in the mid-range frequencies containing human voices. One problem found in the prior art is that the reproduced sound is very harsh and annoying since the ear has greater sensitivity to the range of about 700 Hz to about 7 kHz (kiloHertz) within the mid-range. At these frequencies, a slight shift in the position of the listener's head provides an annoying shift in the stereo image.

Figure 4:
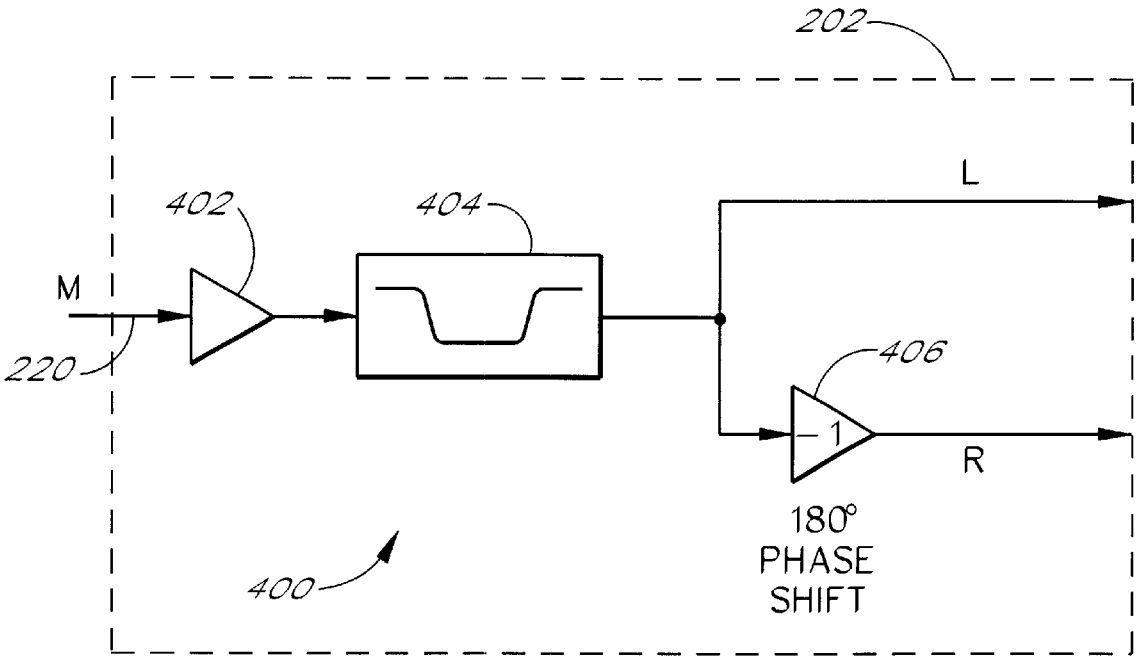
FIG. 4 is a block diagram of one embodiment of a sound enhancement system that uses a perspective filter to generate two pseudo-stereophonic output channels from a single monophonic input channel.

FIG. 4 is a block diagram of a sound enhancement system 400 that provides relatively less ambience in the frequency ranges corresponding to the human voice, and relatively more ambience in other frequency ranges. In the enhancement system 400, the monophonic input signal M 220 is provided through a buffer amplifier 402 to an input of a perspective filter 404. An output of the perspective filter 404 is provided to a first output channel (L−R) and to an input of an inverting amplifier 406 having unity gain. The amplifier 406 provides a 180 degree phase shift. An output of the amplifier 406 is provided to a second output channel (R−L).

The perspective filter 404 de-emphasizes (attenuates) frequency components of the monophonic input 220 that lie in the frequency range corresponding to the human voice (mid-band). Thus the first and second output, channels are attenuated in the frequency range corresponding to the mid-band. However, the outputs are still 180 degrees out of phase in the mid-band and the frequency response of the enhancement system is not uniform (flat). A better enhancement system would provide better uniformity in the frequency response of the outputs and outputs that are closer to being in-phase in the mid-band.

Figure 5:
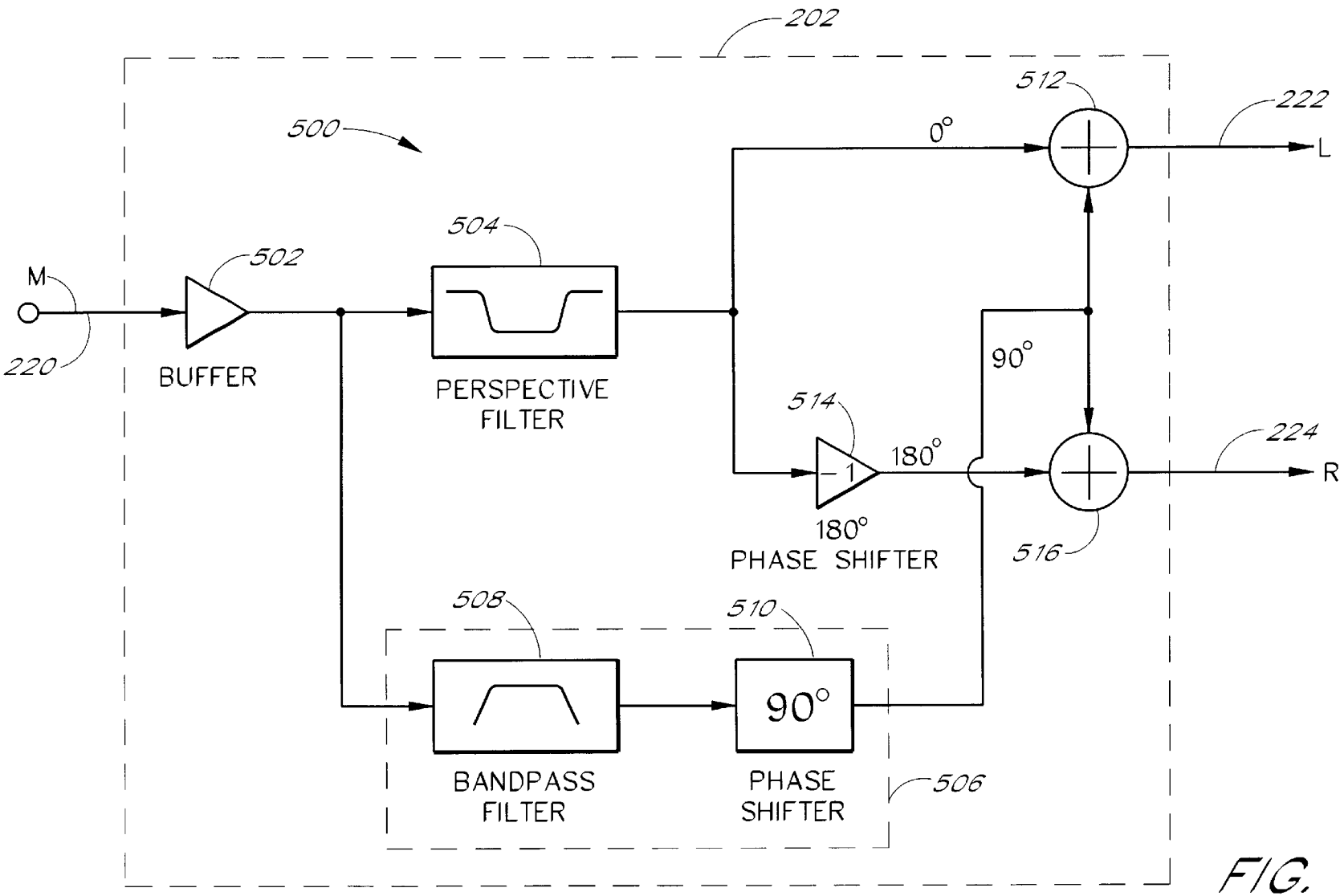
FIG. 5 is a block diagram of one embodiment of a sound enhancement system that uses a perspective filter and an equalizer to generate two pseudo-stereophonic output channels from a single monophonic input channel.

FIG. 5 is a block diagram of a sound enhancement system 500 that provides a more uniform frequency response and outputs that are close to being in-phase across the mid-band frequencies. The system 500 uses a perspective filter 504 and an equalizer 506 to generate two pseudo-stereophonic output channels from a single monophonic input channel. In the system 500, the monophonic input M 220 is provided to an input of a buffer amplifier 502. An output of the amplifier 502 is provided to an input of the perspective filter 504 and to an input of a bandpass filter 508. An output of the perspective filter 504 is provided to a first input of an adder 512, and to an input of an inverting amplifier 514. An output of the inverting amplifier 514 is provided to a first input of an adder 516.

An output of the bandpass filter 508 is provided to an input of a 90 degree phase shifter 510. An output of the phase shifter 510 is provided to a second input of the adder 512 and to a second input of the adder 516. An output of the adder 512 is a left channel output 222 and an output of the adder 516 is a right channel output 224.

The output of the perspective filter 504 is a differential-mode signal. In one embodiment, the differential-mode signal is such that frequencies to which the ear has greater sensitivity (about 400 Hz to 10 kHz, and preferably about 700 Hz to about 7 kHz) are not inappropriately boosted, and so that difference signal components having wavelengths comparable to the distance between the ears of a listener are not inappropriately boosted.

Figure 7:
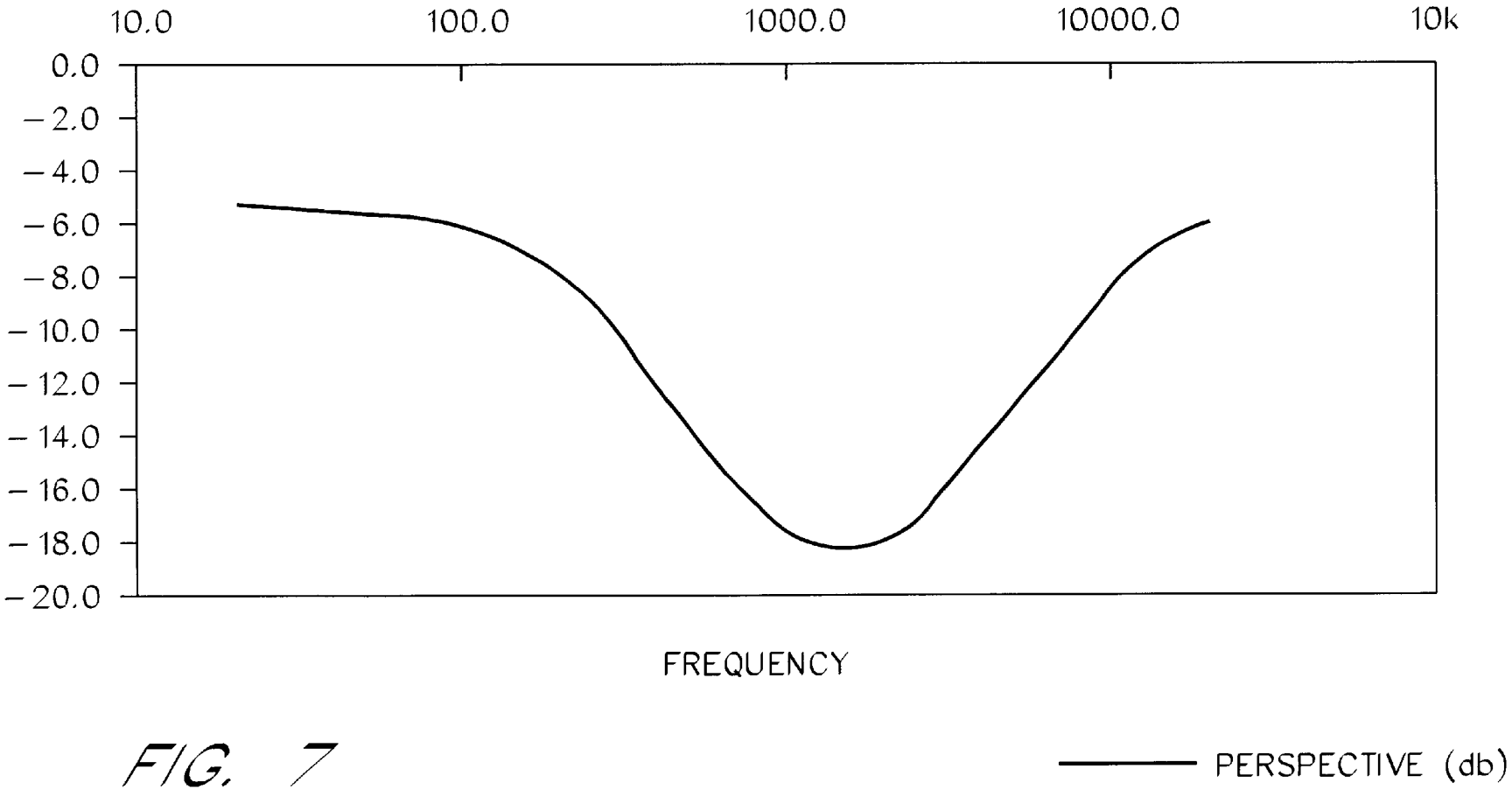
FIG. 7 is a plot of one embodiment of the transfer function of a perspective filter.

The differential-mode signal provided by the perspective filter 504 is, in some respects, a pseudo-difference signal (L–R). The perspective filter 504 selectively attenuates the differential-mode signal as a function of frequency. An example of one embodiment of a perspective filter transfer function is shown in FIG. 7. As shown, the differential-mode signal is particularly attenuated in the mid-band frequency range of about 400 Hz to about 10 kHz, and more particularly about 700 Hz to about 7 kHz. The human ear has greater sensitivity to mid-band frequencies, in part because such frequency range includes difference signal components having wavelengths that are comparable to the distance between a listener's ears. The attenuation in the mid-band frequency range is preferably about 2 to 15 dB.

As discussed previously and relative to the prior art, loud difference signals within such frequencies result in annoying harshness and limit a listener to being located equidistant between the loudspeakers. By attenuating such frequencies, the harshness and the limitation on location are substantially reduced. The mid-band attenuation also partially compensates for the increased sensitivity of the human ear to sounds in the mid-band region. The outer portion of the human ear produces an attenuation of mid-band sounds that come from a source located in front of the listener. A resonance in the inner ear canal is provides increased sensitivity to sounds in the mid-band region, and thus the inner ear compensates for the outer ear. The interaction between the inner ear and the outer ear explains, in part, the physical aspects of the Head Related Transfer Function (HRTF). The mid-band attenuation of the perspective filter provides an effect similar to an HRTF in that it compensates for interactions between the inner ear and the outer ear.

Figure 8:
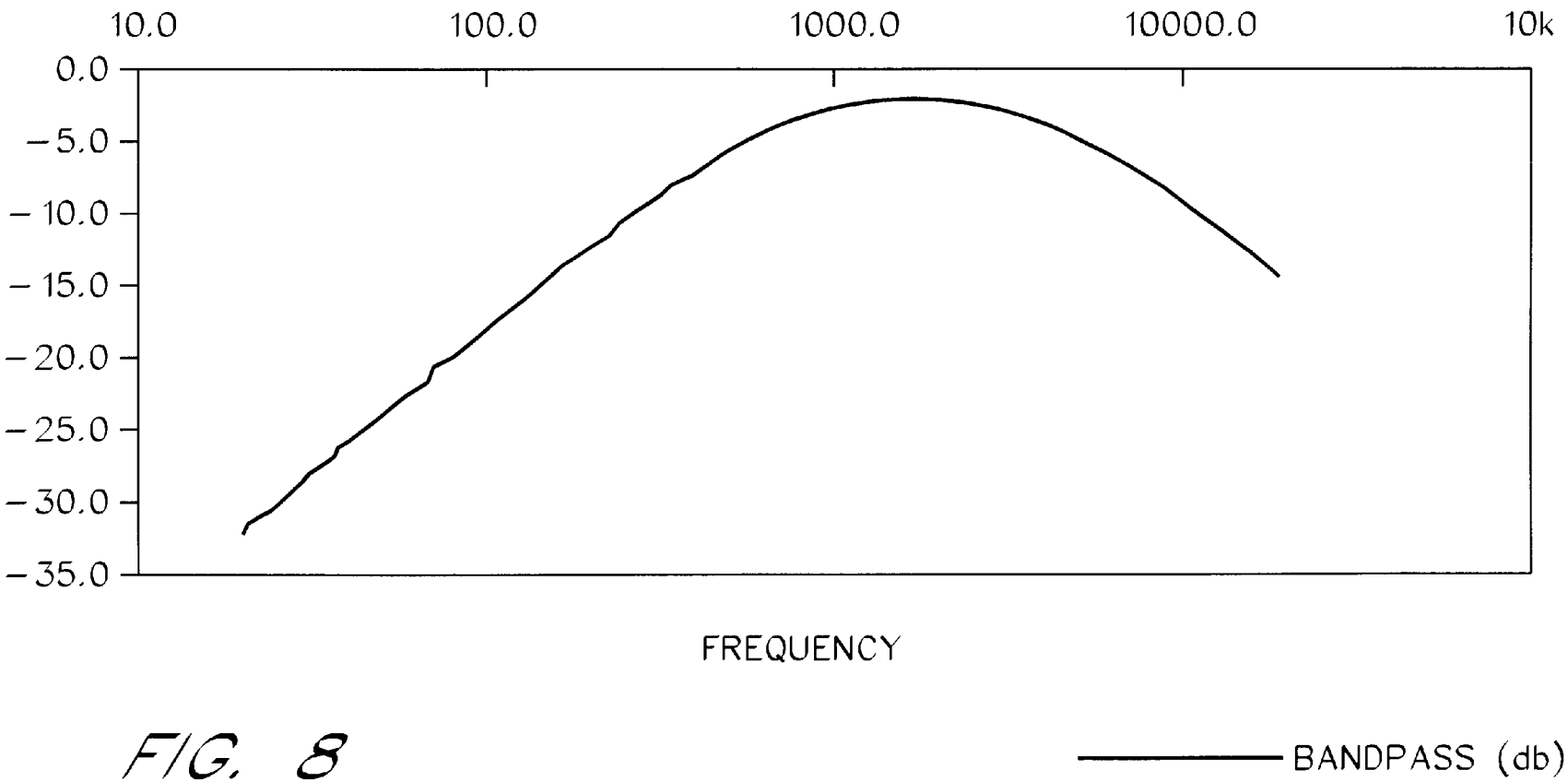
FIG. 8 is a plot of one embodiment of the transfer function of a bandpass filter used in conjunction with the perspective filter transfer function shown in FIG. 7.

An equalizer filter 506 comprising the bandpass filter 508 and the phase shifter 510 provides a common-mode signal to complement the differential-mode signal. The appropriate equalization characteristic for one embodiment of the bandpass filter 508 is shown in FIG. 8. In this embodiment, the bandpass filter 508 has –3 dB frequencies at approximately 700 Hz and 7 kHz, and rolls off at approximately 20 dB per decade. The 6.3 kHz bandwidth of the bandpass filter approximates the operating range of the human voice. In other embodiments, the lower –3 dB frequency may be in the range of 400 Hz to 2000 Hz, and the upper –3 dB frequency may be in the range of 3000 Hz to 10 kHz.

The shifter 510 shifts the output of the bandpass filter 508 approximately 90 degrees with respect to the output of the filter 504. The 90 degree shift approximately centers the common-mode signal between the 0 degree phase output of the filter 504 and the 180 degree phase output of the inverting amplifier 514. Thus, the common-mode signal is approximately equidistant in phase from both the differential-mode signal at the output of the perspective filter 504 and the inverted differential-mode signal at the output of the amplifier 514. In other words, the phase of the common-mode signal is approximately balanced with respect to the inverted and normal differential-mode signals.

The filter transfer characteristic of the perspective filter may also desirably be designed to roll off at a frequency below about 300 Hz at a rate of about 6 dB per octave or more (not shown) to avoid overly emphasized bass. Such low frequency rolloff is particularly desirable when the bass speaker 212 shown in FIG. 2 is included.

The differential-mode signal, produced by the perspective filter, contributes primarily the ambience in the pseudo-stereophonic output. Therefore, components of the differential-mode signal in the mid-band frequency ranges are attenuated relative to the components in the frequency ranges outside the mid-band frequencies. This has the effect of producing less ambience in the mid-band frequencies and more ambience in the other frequency ranges. Preferably, the differential-mode signal components in the mid-range are attenuated about 8 dB relative to the differential-mode signal components on either side of the mid-range. The common-mode signal, produced by the equalizer filter, provides little or no ambience. Therefore, components of the common-mode signal in the mid-band frequency ranges are boosted relative to other frequency ranges such that when the differential-mode and common-mode signal are combined, the resulting signal has more ambience in frequency ranges outside the mid-band.

Figure 9:
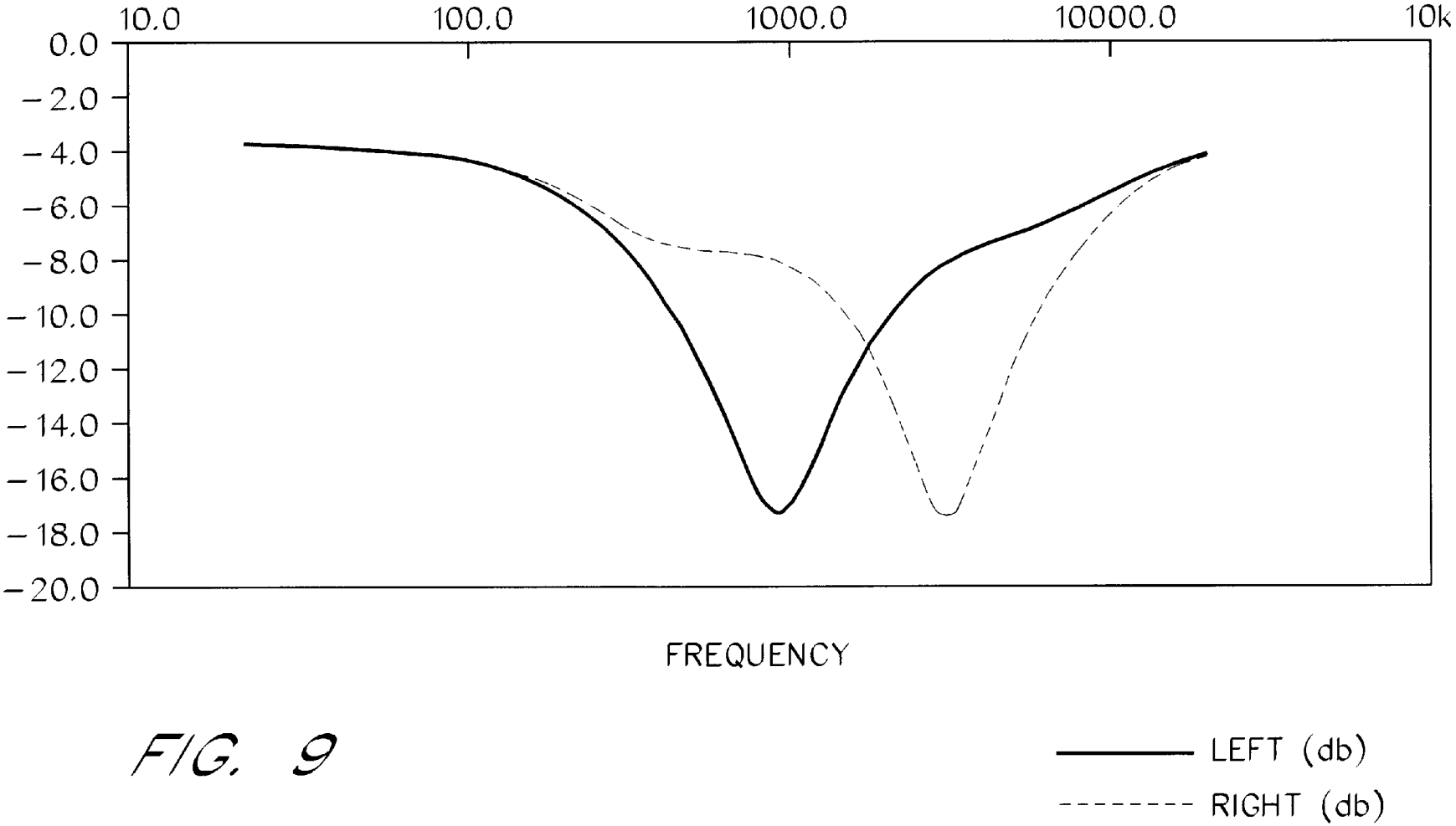
FIG. 9 is a plot of one embodiment of the left and right channel outputs of a pseudo-stereo sound enhancement system.

FIG. 9 is an xy-plot of the left and right channel outputs of the sound enhancement system shown in FIG. 5. The plot in FIG. 9 shows frequency on the x-axis and amplitude (in dB) on the y-axis. In one embodiment, the left and right channels are substantially in-phase and substantially equal in amplitude at a cross-over frequency near 1100 Hz. This cross-over frequency corresponds approximately to the center frequency of the bandpass filter 508 and the center frequency of the perspective filter 504. In other embodiments, the cross-over frequency may fall in a range from about 500 Hz to 9 kHz. In yet other embodiments, the left and right channels are not substantially in-phase at the cross-over frequency. The left and right channels are substantially 180 degrees out-of-phase and equal in amplitude at very high frequencies (e.g., frequencies above 10 kHz) and at very low frequencies (e.g., frequencies below 300 Hz).

II. The Five Capacitor Pseudo-Stereo Synthesizer

Figure 6:
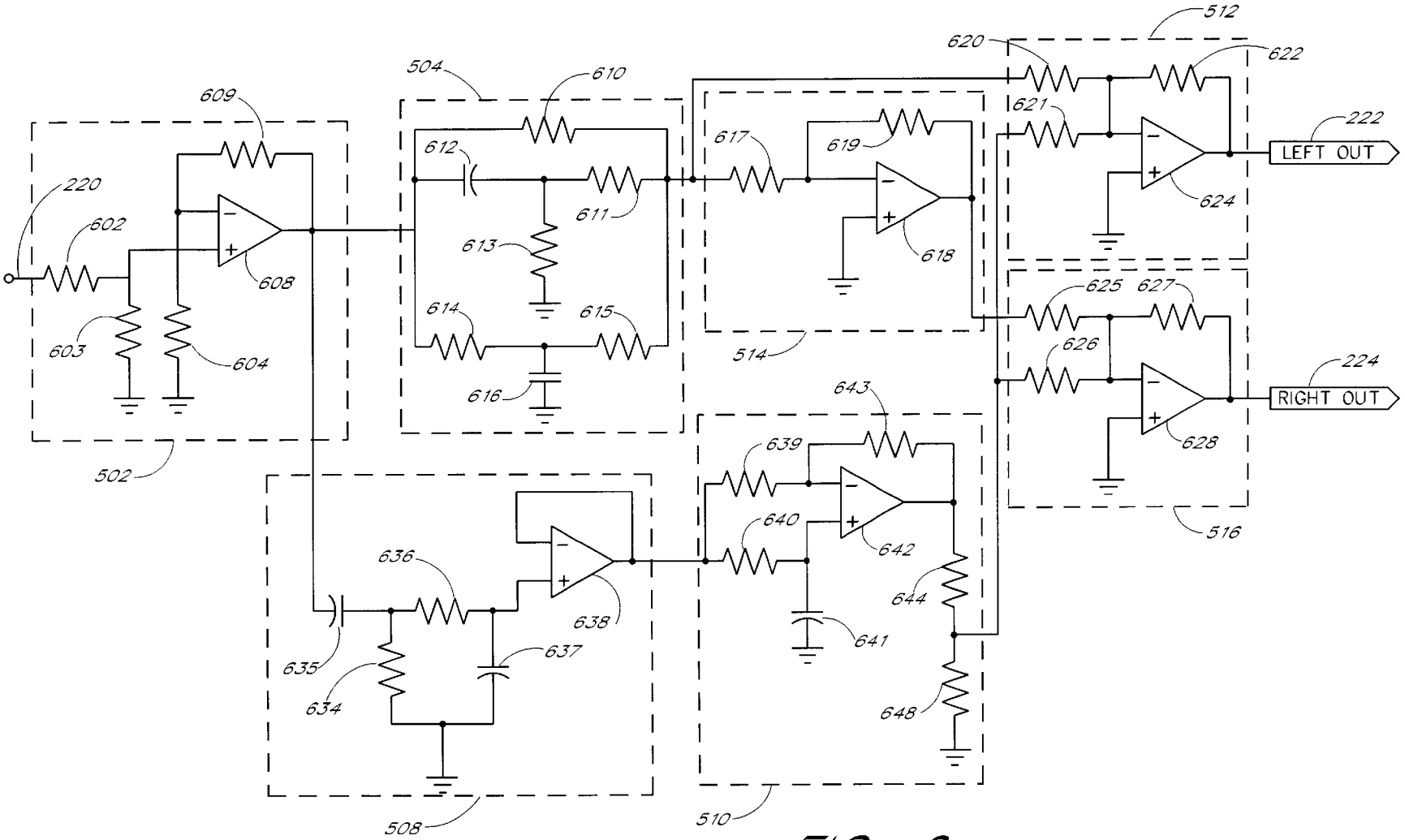
FIG. 6 is a circuit schematic diagram of one embodiment of the sound enhancement system shown in FIG. 5.

The enhancement system 500 may be implement using analog signal processing, digital signal processing, or combinations thereof. One embodiment of an implementation of the enhancement system 500 is shown in FIG. 6. This implementation uses fewer filter capacitors, making it suitable for integrated circuit applications. In FIG. 6, the monophonic input 220 is provided to a first terminal of a resistor 602. A second terminal of the resistor 602 is provided to an ungrounded terminal of a grounded resistor 603 and to a non-inverting input of a buffer amplifier 608. An inverting input of the buffer amplifier 608 is connected an ungrounded terminal of a grounded resistor 604 and to a first terminal of a feedback resistor 609. An output of the amplifier 608 is provided to a second terminal of the feedback resistor 609.

An output of the amplifier 608 is also provided to an input of the perspective filter 504. The input of the perspective filter 504 is provided to the first terminal of a resistor 610, to a first terminal of a capacitor 612, and to a first terminal of a resistor 614. A second terminal of the capacitor 612 is provided to an ungrounded terminal of a grounded resistor 613 and to a first terminal of a resistor 611. A second terminal of the resistor 614 is provided to an ungrounded terminal of a grounded capacitor 616 and to a first terminal of a resistor 615. A second terminal of the resistor 615, a second terminal of the resistor 611, and a second terminal of the resistor 610 are all provided to the output of the perspective filter 504.

The output of the perspective filter 514 is provided to a first terminal of a resistor 617 (the input of the inverting amplifier 514). A second terminal of the resistor 617 is provided to a first terminal of a feedback resistor 619 and to an inverting input of an op-amp 618. A non-inverting input of the op-amp 618 is provided to ground, and an output of the op-amp 618 is provided to a second terminal of the feedback resistor 619.

The output of the op-amp 618, being the output of the inverting amplifier block 514, is also provided to an input of the adder 516 comprising the first terminal of a resistor 625. A second terminal of the resistor 625 is provided to a second terminal of a resistor 626, to a first terminal of a feedback resistor 627, and to an inverting input of an op-amp 628. An output of the op-amp 628 is provided to a second terminal of the feedback resistor 627 and to a right channel output 224.

The output of the op-amp 618 is also provided to an input of the adder 512, comprising the first terminal of a resistor 620. A second terminal of the resistor 620 is provided to a second terminal of a resistor 621, to a first terminal of a feedback resistor 622 and to an inverting input of an op-amp 624. An output of the op-amp 624 is provided to a second terminal of the feedback resistor 622 and to a left channel output 224.

An output of the amplifier 608 is also provided to the first terminal of the bandpass filter 508 comprising the first terminal of capacitor 635. A second terminal of the capacitor 635 is provided to an ungrounded terminal of a grounded resistor 634 and to a first terminal of a resistor 636. A second terminal of the resistor 636 is provided to an ungrounded terminal of a grounded capacitor 637 and to a non-inverting input of an op-amp 638. An output of the op-amp 638 is provided to an inverting input of the op-amp 638. The output of the op-amp 638 is also provided, as an output of the bandpass filter 508, to a first terminal of a resistor 639 and to a first terminal of a resistor 640. A second terminal of the resistor 640 is provided to an ungrounded terminal of a grounded capacitor 641 and to a non-inverting input of an op-amp 642. A second terminal of the resistor 639 is provided to a first terminal of a resistor 643 and to an inverting input of an op-amp 642. An output of the op-amp 642 is provided to a second terminal of the feedback resistor 643 and to a first terminal of a resistor 644. A second terminal of the resistor 644 is provided to an ungrounded terminal of a grounded resistor 648. The second terminal of the resistor 644, being the output terminal of the phase shifter 510, is also provided to a first terminal of the resistor 626 and to a first terminal of the resistor 621.

The op-amps 608, 618, 638, and 642 are preferably TL074 op-amps manufactured by Texas Instruments, Inc. The op-amps 624 and 628 are preferably TL072 op-amps manufactured by Texas Instruments, Inc. Approximate component values for resistors (in kiloOhms) and capacitors (in microFarads) shown in FIG. 5, are listed in Table 1, below.

TABLE 1

| Resistor | Value (approx.) kΩ | Resistor | Value (approx.) kΩ | Capacitor | Value (approx.) μF |
|---|---|---|---|---|---|
| 602 | 10.0 | 620 | 26.1 | 612 | 0.0047 |
| 603 | 10.0 | 621 | 47.5 | 616 | 0.22 |
| 604 | 10.0 | 622 | 75.0 | 635 | 0.1 |
| 609 | 20.0 | 625 | 26.1 | 637 | 0.01 |
| 610 | 110.0 | 626 | 57.6 | 641 | 0.1 |
| 611 | 47.5 | 627 | 75.0 | | |
| 613 | 3.74 | 634 | 1.96 | | |
| 614 | 3.09 | 636 | 3.92 | | |

TABLE 1-continued

| Resistor | Value (approx.) kΩ | Resistor | Value (approx.) kΩ | Capacitor | Value (approx.) μF |
|---|---|---|---|---|---|
| 615 | 49.9 | 639 | 10.0 | | |
| 617 | 26.1 | 640 | 0.909 | | |
| 619 | 26.1 | 643 | 10.0 | | |
| | | 644 | 15.0 | | |
| | | 648 | 2.49 | | |

The embodiment shown in FIG. 6 is advantageously it uses only five filter capacitors, thus making it attractive for integrated circuit implementations. Filter capacitors are difficult to implement in integrated circuits. Integrated circuits, such as Dynamic Random Access Memories (DRAMs)may contain millions of capacitors, but the capacitors used in DRAMS are used for short-term charge storage rather than as filter capacitors. Thus, the value of the capacitance in the capacitors used in DRAMs is very small, typically less than 80 pico-Farads. By contrast, the capacitors used in audio circuits are typically much larger, having values of up to 0.1 micro-Farads or more.

For these reasons, integrated circuits used in filtering applications typically do not use internal capacitors, but rather rely on external capacitors. Typically, each external capacitor requires at least one external connection (e.g., at least one pin) on the integrated circuit. Thus, the number of filter capacitors required affects the number of external connections on the integrated circuit, and therefor the size and cost of the integrated circuit. The circuit shown in FIG. 6, advantageously uses fewer capacitors.

III. Pseudo-Stereophonic Recordings

Embodiments of the present invention are applicable either for playback of conventional stereo sound recordings, or for the manufacture of unique stereo sound recordings which will provide advantages described above when played back through conventional sound reproduction systems. Thus, the enhancement provided by the disclosed stereo enhancement system 202 can be advantageously utilized to enhance recordings. Such recordings can be played back on an audio system that does not include the stereo enhancement system 202, or an audio system that includes the stereo enhancement system 202 that has been bypassed.

A system having the enhancement system 202 described herein includes a conventional stereophonic playback apparatus which may respond to a digital record, such as a laser disc, a Digital Versatile Disc (DVD), a phonograph record, a magnetic tape, or the sound channel on video tape or motion picture film. The playback apparatus provides left and right channel stereo signals L, R an amplifier from which the left and right signals are fed to the loudspeakers.

A similar arrangement is used in making a recording that will itself bear data in the form of physical grooves of a phonograph record, magnetic domains of a magnetic tape or like medium, or digital information that may be read by optical means. Such data defines left and right stereo signals formed of signal components that, when played back on a conventional sound reproducing system, produce all of the advantages described above. Thus, a recording system for making a sound recording embodying principles of the invention may receive a monophonic input signal from a microphone 104 or a conventional monophonic playback system, such as the system 108, which is adapted to provide a monophonic input signal M 220. The playback system 108, may provide its output signals from any conventional record medium including digital records such as a laser disc, phonograph records, magnetic tape, or video or film sound track media.

When the enhancement system 202 of FIG. 2 is employed to make a record having ambience enhancement, such a record cooperates with a conventional stereo player to produce left and right pseudo-stereophonic output signals having components including an enhanced signal that provides the perception of ambience. A record made by the apparatus and method described herein is distinguished from other stereophonic records in that unique signal generating data is embodied in the record. Upon playback of such a unique record by conventional record playing medium, pseudo-stereophonic sound will be produced having the above-described advantages, including the specified signal components.

IV Other Embodiments

The foregoing has been a disclosure of systems for substantially improving the ambience and stereophonic image resulting from recorded performances, both in playback of conventional records and in the production of improved recordings. Such systems are readily utilized with standard audio equipment and are readily added to existing audio equipment. Further, the disclosed systems may be easily incorporated into preamplifiers and/or integrated amplifiers. Such incorporation may include provisions for bypassing the disclosed systems.

The disclosed stereo enhancement system is readily implemented using analog techniques, digital techniques, or a combination of both. Further, the disclosed stereo enhancement system is readily implemented with integrated circuit techniques.

Also, the disclosed systems may be utilized with or incorporated into a variety of audio systems including airline entertainment systems, theater sound systems, recording systems for producing recordings which include image enhancement and/or perspective correction, and electronic musical instruments such as organs and synthesizers.

Further, the disclosed systems would be particularly useful in automotive sound systems, as well as sound systems for other vehicles such as boats.

Although the foregoing has been a description and illustration of specific embodiments of the invention, various modifications and changes thereto can be made by persons skilled in the art without departing from the scope and spirit of the invention as defined by the following claims.

What is claimed is:

1. A stereo synthesizing apparatus to produce left and right pseudo-stereophonic output signals from a monophonic signal, comprising:

a monophonic input configured to receive a monophonic signal;

a perspective filter operatively couples to said monophonic input, said perspective filter configured to de-emphasize selected frequency portions of said monophonic signal to produce a first filtered signal;

a bandpass filter operative coupled to said monophonic input, said bandpass filter configured to pass frequencies of said monophonic signal containing human voice information;

a ninety-degree phase shifter operatively coupled to an output of said bandpass filter to produce a second filtered signal;

a left channel mixer adapted to add said first filtered signal to said second filtered signal to produce a left channel output signal; and a right channel mixer adapted to subtract said first filtered signal from said second filtered signal to produce a right channel output signal, wherein the left channel output signal and the right channel output signal have a lower phase difference in a mid band frequency range and a higher phase difference at very high frequencies.

2. The stereo synthesizing apparatus of claim 1, wherein said perspective filter de-emphasizes frequency components in a frequency range centered near 2000 Hz.

3. The stereo synthesizing apparatus of claim 1, wherein said perspective filter provides a maximum de-emphasis of approximately 8 dB.

4. The stereo synthesizing apparatus of claim 1, wherein said bandpass filter has a passband centered at approximately 2000 Hz.

5. The stereo synthesizing apparatus of claim 1, wherein said perspective filter de-emphasizes frequencies in a frequency band corresponding to a bandwidth of said bandpass filter.

6. A signal processor that produces more outputs than inputs, comprising:

a first filter operatively coupled to an input signal, said first filter configured to de-emphasize frequency components relative to other frequency components of said input signal to produce a first filtered signal;

a second filter operatively coupled to said input signal, said second filter configured to emphasize frequency components relative to other frequency components of said input signal to produce a second filtered signal;

a first combiner that combines at least a portion of said first filtered signal with at least a part of said second filtered signal to produce a first channel output signal; and a second combiner that combines at least a portion of said first filtered signal with at least a portion of said second filtered signal to produce a second channel output signal, wherein the first channel output signal and the second channel output signal have a lower phase difference in a mid band frequency range and a higher phase difference at very high frequencies.

7. The signal processor of claim 6, wherein said first filter comprises a perspective filter.

8. The signal processor of claim 7, wherein said perspective filter de-emphasizes frequencies in a frequency band centred near 2000 Hz.

9. The signal processor of claim 7, wherein said perspective filter de-emphasizes frequencies in a frequency band corresponding to frequencies produced by a human vocal tract.

10. The signal processor of claim 6, wherein said second filter comprises a bandpass filter.

11. The signal processor of claim 6, wherein said second filter comprises a ninety-degree phase shifter.

12. The signal processor of claim 6, wherein said first combiner comprises an adder.

13. The signal processor of claim 6, wherein said second combiner comprises a subtractor.

14. The signal processor of claim 6, wherein said first combiner is an adder and said second combiner is a subtractor.

15. The stereo synthesizer of claim 6, wherein said input signal is a monophonic signal, said first channel output signal is a first pseudo-stereo signal, and said second channel output signal is a second pseudo-stereo signal.

16. A method for audio signal processing comprising the acts of:

filtering an input signal in a first filter to de-emphasize frequency components relative to other frequency components of said input signal to produce a first filtered signal;

filtered said input signal in a second filter to emphasize frequency components relative to other frequency components of said input signal to produce a second filtered signal;

combining by a first combining method at least a portion of said first filtered signal with at least a portion of said second filtered signal to produce a left output signal; and combining by a second combining method at least a portion of said first filtered signal and at least a portion of said second filtered signal to produce a right output signal, wherein the left output signal and the right output signal have a lower phase difference in a mid band frequency range and a higher phase difference at very high frequencies.

17. The method of claim 16, wherein said first filter comprises a perspective filter.

18. The method of claim 16, wherein said second filter comprises a bandpass filter.

19. The method of claim 16, wherein said second filter comprises a phase shifter.

20. The method of claim 16, wherein said first combining method comprises summing.

21. The method of claim 16, wherein said second combining method comprises subtracting.

22. The method of claim 16, wherein said first combining method comprises summing and said second combining method comprises subtracting.

23. The method of claim 16, further comprising the act of recording said left and right output signals.

24. The method of claim 16, further comprising the act of broadcasting said left and right output signals.

25. The method of claim 16, further comprising the act of providing said left and right output signals to loudspeakers.

26. A pseudo-stereo sound recording made by the method of claim 16.

27. A signal processor that produces more outputs than inputs, comprising:

first filter means for filtering an input signal to de-emphasize frequency components relative to other frequency components of said input signal to produce a first filtered signal;

second filter means for filtering said input signal to emphasize frequency components relative to other frequency components of said input signal to produce a second filtered signal;

first combiner means for combining at last a portion of said first filtered signal with at least a part of said second filtered signal to produce a first output signal; and second combiner means for combining at least a portion of said first filtered signal with at least a portion of said second filtered signal to produce a second output signal, wherein the first output signal and the second output signal have a lower phase difference in a mid band frequency range and a higher phase difference at very high frequencies.

28. The signal processor of claim 27, wherein said first filter means comprises a perspective filter.

29. The signal processor of claim 28, wherein said perspective filter de-emphasizes frequencies in a frequency band centered near 2000 Hz.

30. The signal processor of claim 28, wherein said perspective filter de-emphasizes frequencies in a frequency band corresponding to frequencies produced by a human vocal tract.

31. The signal processor of claim 27, wherein said second filter means comprises a bandpass filter.

32. The signal processor of claim 27, wherein said second filter means comprises a ninety-degree phase shifter.

33. The signal processor of claim 27, wherein said first combiner means comprises an adder.

34. The signal processor of claim 27, wherein said second combiner means comprises a subtractor.

35. A stereo synthesizing apparatus to produce left and right pseudo-stereophonic output signals from a monophonic signal, comprising:

a monophonic input configured to receive a monophonic signal;

a perspective filter operatively coupled to said monophonic input, said perspective filter configured to de-emphasize selected frequency portions of said monophonic signal to produce a first filtered signal;

a bandpass filter operative coupled to said monophonic input, said bandpass filter configured to pass frequencies of said monophonic signal containing human voice information;

a ninety-degree phase shifter operatively coupled to an output of said bandpass filter to produce a second filtered signal;

a left channel mixer adapted to add said first filtered signal to said second filtered signal to produce a left channel output signal; and a right channel mixer adapted to subtract said first filtered signal from said second filtered signal to produce a right channel output signal, wherein said left channel output signal and said right channel output signal are in-phase at a frequency of approximately 2000 Hz.

36. The stereo synthesizing apparatus of claim 35, wherein said perspective filter de-emphasizes components in a frequency range centered near 2000 Hz.

37. The stereo synthesizing apparatus of claim 35, wherein said perspective filter provides a maximum de-emphasis of approximately 8 dB.

38. The stereo synthesizing apparatus of claim 35, wherein said bandpass filter has a passband centered at approximately 2000 Hz.

39. The stereo synthesizing apparatus of claim 35, wherein said perspective filter de-emphasizes frequencies in a frequency band corresponding to a bandwidth of said bandpass filter.

40. A signal processor that produces more outputs than inputs, comprising:

a first filter operatively coupled to an input signal, said first filter configured to de-emphasize frequency components relative to other frequency components of a first mid-band frequency range of said input signal to produce a first filtered signal;

a second filter operatively coupled to said input signal, said second filter configured to emphasize frequency components relative to other frequency components of a second mid-band frequency range of said input signal to produce a second filtered signal;

a first combiner that combines at least a portion of said first filtered signal with at least a part of said second filtered signal to produce a first output signal; and a second combiner that combines at least a portion of said first filtered signal with at least a portion of said second filtered signal to produce a second output signal, wherein said first output signal and said second output signal are in-phase at a frequency of approximately 2000 Hz.

41. The signal processor of claim 40, wherein said first filter comprises a perspective filter.

42. The signal processor of claim 41, wherein said perspective filter de-emphasizes frequencies in a frequency and centered near 2000 Hz.

43. The signal processor of claim 41, wherein said perspective filter de-emphasizes frequencies in a frequency band corresponding to frequencies produced by a human vocal tract.

44. The signal processor of claim 40, wherein said second filter comprises a bandpass filter.

45. The signal processor of claim 40, wherein said second filter comprises a ninety-degree phase shifter.

46. The signal processor of claim 40, wherein said first combiner comprises an adder.

47. The signal processor of claim 40, wherein said second combiner comprises a subtractor.

48. The signal processor of claim 40, wherein said first combiner is an adder and said second combiner is a subtractor.

49. The stereo synthesizer of claim 40, wherein said input signal is a monophonic signal, said first output signal is a first pseudo-stereo signal, and said second output signal is a second pseudo-stereo channel.

50. A method for audio signal processing comprising the acts of:

filtering and input signal in a first filter to de-emphasize frequency components relative to other frequency components of a first mid-band frequency range of said input signal to produce a first filtered signal;

filtering said input signal in a second filter to emphasize frequency components relative to other frequency components of a second mid-band frequency range of said input signal to produce a second filtered signal;

combining by a first combining method at least a portion of said first filtered signal with at least a portion of said second filtered signal to produce a left output signal; and combining by a second combining method at least a portion of said first filtered signal and at least a portion of said second filtered signal to produce a right output signal, wherein said left output signal and said right output signal are in-phase at a frequency of approximately 2000 Hz.

51. The method of claim 50, wherein said first filter comprises a perspective filter.

52. The method of claim 50, wherein said second filter comprises a bandpass filter.

53. The method of claim 50, wherein said second filter comprises a phase shifter.

54. The method of claim 50, wherein said first combining method comprises summing.

55. The method of claim 50, wherein said second combining method comprises subtracting.

56. The method of claim 50, wherein said first combining method comprises summing and said second combining method comprises subtracting.

57. The method of claim 50, further comprising the act of recording said left and right output signals.

58. The method of claim 50, further comprising the act of broadcasting said left and right output signals.

59. The method of claim 50 further comprising the act of providing said left and right output signals to loudspeakers.

60. A pseudo-stereo sound recording made by the method of claim 50.

61. A signal processor that produces more outputs than inputs, comprising:

first filter means for filtering an input signal to de-emphasize frequency components relative to other frequency components of a first mid-band frequency range of said input signal to produce a first filtered signal;

second filter means for filtering said input signal to emphasize frequency components relative to other frequency components of a second mid-band frequency range of said input signal to produce a second filtered signal;

first combiner means for combining at least a portion of said first filtered signal with at least a part of said second filtered signal to produce a first output signal; and second combiner means for combining at least a portion of said first filtered signal with at least a portion of said second filtered signal, to produce a second output signal, wherein said first output signal and said second output signal are in-phase at a frequency of approximately 2000 Hz.

62. The signal processor of claim 61, wherein said first filter means comprises a perspective filter.

63. The signal processor of claim 62, wherein said perspective filter de-emphasizes frequencies in a frequency band centered near 2000 Hz.

64. The signal processor of claim 62, wherein said perspective filter de-emphasizes frequencies in a frequency band corresponding to frequencies produced by a human vocal tract.

65. The signal processor of claim 61, wherein said second filter means comprises a bandpass filter.

66. The signal processor of claim 61, wherein said second filter means comprises a ninety-degree phase shifter.

67. The signal processor of claim 61, wherein said first combiner means comprises an adder.

68. The signal processor of claim 61, wherein said second combiner means comprises a subtractor.

69. The stereo synthesizing apparatus of claim 1 wherein the left channel output signal and the right channel output signal are substantially in-phase in the mid band frequency range and substantially out of phase at very high frequencies.

70. The stereo synthesizing apparatus of claim 1 wherein the left channel output signal and the right channel output signal are substantially in-phase in the mid band frequency range, and substantially out of phase at very low frequencies.

71. The stereo synthesizing apparatus of claim 1 wherein the left channel output signal and the right channel output signal are substantially in-phase in the mid band frequency range and substantially out of phase at very high and very low frequencies.

72. The stereo synthesizing apparatus of claim 1 wherein the stereo synthesizing apparatus phase equalizes the left channel output signal and the right channel output signal such that the left and right channel output signals are substantially in-phase in a frequency band corresponding to human voice.

73. The stereo synthesizing apparatus of claim 1 wherein the left channel output signal and the right channel output signal are substantially in-phase in a frequency band corresponding to human voice.

74. The stereo synthesizing apparatus of claim 1 wherein the mid band frequency range is about 400 Hz to about 10 KHz, and more particularly about 700 Hz to about 7 KHz.

75. The stereo synthesizing apparatus of claim 1 wherein the left channel output signal and the right channel output signal are substantially in-phase and substantially equal in amplitude at a crossover frequency near 1100 Hz.

76. The stereo synthesizing apparatus of claim 1 wherein the left channel output signal and the right channel output signal are substantially 180 degrees out of phase and equal in amplitude at frequencies above about 10 KHz.

77. The stereo synthesizing apparatus of claim 1 wherein the left channel output signal and the right channel output signal are substantially 180 degrees out of phase and equal in amplitude at frequencies below about 300 Hz.

78. The stereo synthesizing apparatus of claim 1 wherein the left channel output signal and the right channel output signal are substantially in-phase and substantially equal in amplitude at a crossover frequency in a range of about 500 Hz to about 9 KHz.

* * * * *